United States Patent [19]

Ali

[11] Patent Number: 5,029,802

[45] Date of Patent: Jul. 9, 1991

[54] SOAP SAVING DEVICE

[76] Inventor: Athar Ali, 4698 Highway 124, Hoschton, Ga. 30548

[21] Appl. No.: 483,832

[22] Filed: Feb. 23, 1990

[51] Int. Cl.[5] ..... A47K 5/00; A47G 35/00

[52] U.S. Cl. ..... 248/684; 206/77.1; 248/309.1; 248/309.2; 252/93

[58] Field of Search ..... 206/77.1, 525; 248/309.1, 309.2, 311.2, 312.1, 684; D6/532; 252/90, 93

[56] References Cited

U.S. PATENT DOCUMENTS

| | | | |
|---|---|---|---|
| 453,538 | 6/1891 | Berninghaus | 206/77.1 |
| 511,323 | 12/1893 | Blasi | 206/77.1 |
| 622,873 | 4/1899 | Welch | 252/92 |
| 2,577,114 | 12/1951 | Eames | 248/684 |
| 2,603,032 | 7/1952 | Huber | 248/684 |
| 2,928,537 | 3/1960 | Stagner | 206/525 |
| 3,104,490 | 9/1963 | Cornell | 248/684 |
| 3,108,392 | 10/1963 | Sams | 248/684 |
| 3,164,356 | 1/1965 | Zajaczkowski | 248/684 |
| 3,196,112 | 7/1965 | Presley | 252/92 |
| 3,325,133 | 6/1967 | Bertges | 248/309.2 |
| 3,529,531 | 9/1970 | Swett | 206/525 |
| 3,532,633 | 10/1970 | Withers | 206/77.1 |
| 3,697,111 | 10/1972 | Thompson | 248/684 |
| 3,969,256 | 7/1976 | Hadley et al. | 252/92 |
| 4,741,852 | 5/1988 | Ondracek | 252/92 |

FOREIGN PATENT DOCUMENTS

| | | | |
|---|---|---|---|
| 2446104 | 9/1980 | France | 206/77.1 |

*Primary Examiner*—David T. Fidei

*Attorney, Agent, or Firm*—Henderson & Sturm

[57] ABSTRACT

A soap saving device (10) for a bar of soap (100); wherein the outer surface (12) of the device (10) is provided with a plurality of discrete protuberances (16); and, the inner surface (13) of the device (10) is contoured to conform generally to the external surface of the bar of soap (100), and provided with a plurality of elongated penetrating elements (18) dimensioned to penetrate the bar of soap (100), to create a frictional engagement between the bar of soap (100) and the device (10).

1 Claim, 1 Drawing Sheet

SOAP SAVING DEVICE

TECHNICAL FIELD

The present invention relates to the field of soap saving devices in general and in particular to an externally applied soap saving and holding device.

BACKGROUND ART

As can be seen by reference to the following U.S. Pat. No's. 4,741,852; 3,969,256; and 3,196,112; the prior art is replete with myriad and diverse soap saving devices.

While all of the aforementioned prior art constructions are more than adequate for the basic purpose and function for which they have been specifically designed, these prior art constructions are either too bulky, cumbersome or costly to manufacture when weighed against the relatively simple task that they are intended to perform in maximizing the useful life of a bar of soap.

In addition none of the aforementioned prior art constructions is intended to be reusable and as a consequence these patented structures themselves have an extremely limited useful life.

As a consequence of the foregoing situation, there has existed a longstanding need among consumers for a soap saving device which is not only compact, lightweight, functional, and inexpensive; but one which also can be used with a large number of bars of soap in successive fashion; and, the provision of such a construction is a stated objective of the present invention.

DISCLOSURE OF THE INVENTION

Briefly stated, the soap saver device that forms the basis of the present invention comprises a generally rigid contoured elliptical soap holding member having a concave outer surface and a convex inner surface wherein the holding member is dimensioned and configured to conform generally to the crown of an oval shaped bar of soap.

In addition the generally rigid holding member is fabricated as a solid piece so that the portion of the crown of the bar of soap that is covered by the elliptical member will be substantially protected from the deleterious wear caused by water and friction on the exposed portions of the bar of soap.

As will be explained in greater detail further on in the specification, both the convex and the concave surfaces of the soap holding member are provided with protuberances of different size, shape and location which cooperate to improve and enhance the most desirable functional features of an ideal soap saver construction to wit; ease of handling, prolonged life of both the bar of soap and the soap holding member, improved user grip on the bar of soap, and a self draining, drying and covering function.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
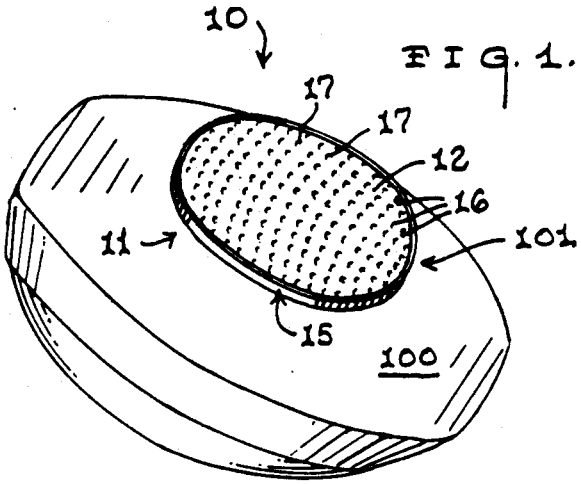
FIG. 1 is a perspective view of the soap saving device installed on a bar of soap.

As can be seen by reference to the drawings, and in particular to FIG. 1, the soap saving device that forms the basis of the present invention is designated generally by the reference numeral (10). The device (10) comprises in general a relatively rigid contoured elliptical soap holding member (11) having a concave outer surface (12) and a convex inner surface (13); wherein, the device (10) is dimensioned to cover and generally conform to a portion of the crown (101) of a bar of soap (100) having an oval configuration.

In the preferred embodiment of the invention depicted in the drawings the device (10) is fabricated from a generally rigid water impervious material (14) such as plastic or the like; and the periphery of the concave (12) and convex (13) surfaces are defined by a downwardly depending relatively short peripheral skirt element (15) whose purpose and function will be described presently.

Figure 2:
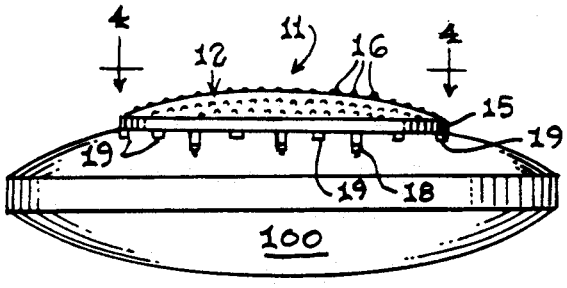
FIG. 2 is a side plan view of the soap saving device in conjunction with a bar of soap.

As can best be seen by reference to FIGS. 1 and 2, the concave outer surface (12) is provided with a plurality of relatively short discrete nub-shaped protuberances (16) which are preferably aligned in spaced parallel rows (17) which are disposed perpendicular to the longitudinal axis of the soap holding member (11). However it should also be noted that in keeping with the teachings of this invention that the plurality of protuberances may be distributed randomly on the concave surface (12) of the soap holding member (11) as long as they provide a frictional gripping surface for the users hand and/or fingers to facilitate the users grasp on the bar of soap (100).

Figure 3:
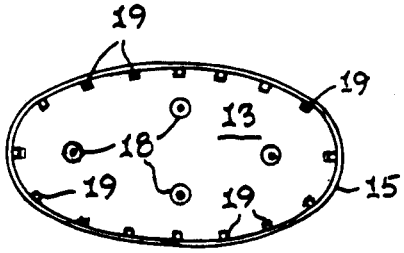
FIG. 3 is a bottom plan view of the device.
Figure 4:
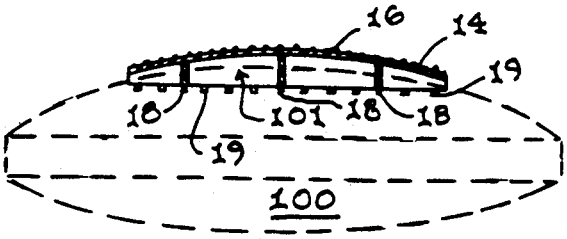
FIG. 4 is a partial cross-sectional view of the device.

Turning now to FIGS. 2 through 4, it can be seen that the convex surface (13) of the soap holding member is provided with a plurality of relatively elongated penetrating post elements (18) which are dimensioned, configured, and intended to penetratingly engage the bar of soap (100) to produce a frictional engagement between the bar of soap and the soap holding member (11); wherein, the frictional engagement will be reinforced by the users grasp on both the device (10) and the soap (100) in a well recognized fashion.

Still referring to FIGS. 2 through 4 it can be seen that the lower portion of the skirted periphery (15) of the soap holding member (11) is provided with a plurality of spaced, downwardly depending intermediate length teeth (19) which serve a dual function. First of all, the teeth (19) are intended to also penetrate the surface of the bar of soap (100); to anchor the skirt (15) in close proximity to the surface of the soap (100); and, to further enhance the frictional engagement between the device (10) and the bar of soap. Furthermore, the teeth (19) will allow both water and air to pass between the surface of the soap (100) and the skirt (15) while the skirt (15) is still effectively attached to the bar of soap by the penetrating engagement of the teeth.

This last feature is particularly important in that although the skirt (15) is intended to cover and insulate the bar of soap (100) from the deleterious effects of water, it is inevitable that water will collect on the interior convex surface (13), particularly when the bar of soap (100) is rested on top of a support surface (not shown) wherein the concave surface (12) of the device is in contact with the support surface.

In this particular orientation partially dissolved or liquefied soap will run down the sides of the bar of soap, passing between the spaced teeth (19) and over the lip of the skirt (15) to be collected on the convex surface (13) of the device. In addition, the collected liquefied soap will not only be prevented from reaching the surface upon which the concave surface rests, but the passage of air along the previous flow path of the liquefied soap will harden the liquefied soap (100) so that it can be usefully employed the next time that holder equipped soap bar is used.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A soap saving device for use with a bar of soap, wherein the device consists of a relatively small generally rigid soap holding member having a concave outer surface provided with a plurality of discrete nub shaped protuberances, and a convex inner surface provided with a plurality of downwardly depending relatively elongated penetrating elements for penetrating the bar of soap to create an operative frictional engagement between the bar of soap and the device; wherein the outer periphery of the inner and outer surfaces are further provided with a downwardly depending relatively short peripheral skirt element provided with a plurality of spaced intermediate length teeth which depend downwardly from said skirt element to a greater extent than said skirt element; wherein, said teeth are also dimensioned to at least partially penetrate the bar of soap; and, the spaces between the teeth are provided to both permit water to drain from the inner surface as well as allow air to circulate over the covered portion of the bar of soap; and wherein the soap holding member is dimensioned to cover only a small portion of one side of a new bar of soap.

* * * * *

UNITED STATES PATENT AND TRADEMARK OFFICE

CERTIFICATE OF CORRECTION

PATENT NO. : 5,029,802

DATED : July 9, 1991

INVENTOR(S) : Athar Ali

It is certified that error appears in the above-identified patent and that said Letters Patent is hereby corrected as shown below:

Column 1, line 38, change [concave] to convex, and [convex] to concave
Column 1, line 49, change [convex] to concave, and [concave] to convex
Column 2, line 11, change [concave] to convex
Column 2, line 12, change [convex] to concave
Column 2, line 20, change [concave] to convex
Column 2, line 21, change [convex] to concave
Column 2, line 25, change [concave] to convex
Column 2, line 32, change [concave] to convex
Column 2, line 38, change [convex] to concave
Column 2, line 65, change [convex] to concave
Column 2, line 67, change [concave] to convex
Column 3, line 4, change [convex] to concave
Column 3, line 7, change [concave] to convex
Column 4, line 2, change [concave] to convex
Column 4, line 4, change [convex] to concave

Signed and Sealed this

Twentieth Day of April, 1993

*Attest:*

MICHAEL K. KIRK

*Attesting Officer*

*Acting Commissioner of Patents and Trademarks*